United States Patent [19]

Rudszinat

[11] Patent Number: 4,574,816

[45] Date of Patent: Mar. 11, 1986

[54] METHOD AND APPARATUS FOR FORMING A FILLER OF FIBROUS MATERIAL

[75] Inventor: Willy Rudszinat, Dassendorf, Fed. Rep. of Germany

[73] Assignee: Hauni-Werke Körber & Co. KG, Hamburg, Fed. Rep. of Germany

[21] Appl. No.: 575,167

[22] Filed: Jan. 30, 1984

[30] Foreign Application Priority Data

Feb. 4, 1983 [DE] Fed. Rep. of Germany ..... 3303776
Dec. 16, 1983 [DE] Fed. Rep. of Germany ..... 3345608

[51] Int. Cl.[4] ..... A24C 5/18

[52] U.S. Cl. ..... 131/84.4; 131/904; 131/905; 131/906

[58] Field of Search ..... 131/84 C, 84.4, 904, 131/905, 906

[56] References Cited

U.S. PATENT DOCUMENTS 4,063,563 12/1977 Lorenzen ..... 131/84 C
4,185,644 1/1980 Heitmann et al. ..... 131/109 R
4,190,061 2/1980 Heitmann et al. ..... 131/84 C
4,235,248 11/1980 Schumacher ..... 131/108

FOREIGN PATENT DOCUMENTS 1159326 12/1963 Fed. Rep. of Germany ..... 131/108

*Primary Examiner*—V. Millin
*Attorney, Agent, or Firm*—Peter K. Kontler

[57] ABSTRACT

A continuous rod-like filler which is ready for draping into a web of cigarette paper is obtained by removing the surplus of tobacco from a continuous tobacco stream which is formed at one side of a foraminous belt conveyor the other side of which is adjacent to a suction chamber serving to attract the particles of tobacco to the conveyor. The surplus is removed downstream of the zone where the particles of tobacco are delivered to the conveyor. The density of the filler is monitored subsequent to draping, and the signals which are generated by the density monitoring device are used to vary the pressure in the suction chamber, to vary the speed of a first rotary conveyor which propels particles of tobacco against the belt conveyor and/or to vary the rate of feed of tobacco particles to the belt conveyor by adjusting the speed of a second rotary conveyor which draws tobacco particles from the lower end of a duct. Each of the above adjustments is effective to change the density of the filler so that the changed density matches or more closely approximates an optimum value. The plane in which the surplus is removed from the tobacco stream is maintained at a constant distance from the belt conveyor.

31 Claims, 3 Drawing Figures

METHOD AND APPARATUS FOR FORMING A FILLER OF FIBROUS MATERIAL

CROSS-REFERENCE TO RELATED CASE

The apparatus of the present application is similar to that which is disclosed in the commonly owned copending patent application Ser. No. 576,168 filed Jan. 30, 1984 by Gottfried Hoffmann for "Method and apparatus for forming rod-shaped articles of the tobacco processing industry".

BACKGROUND OF THE INVENTION

The present invention relates to a method and apparatus for converting particles of tobacco, fibrous tobacco smoke filtering substances or analogous fibrous materials into a continuous stream, and more particularly to improvements in a method and apparatus for forming a continuous rod-like filler of such fibrous material. A filler is a stream which has been relieved of surplus material and is ready to be draped into a web of cigarette paper or other wrapping material to form therewith a rod which can be subdivided into filter rod sections or plain cigarettes, cigarillos or cigars of unit length or multiple unit length.

A tobacco filler is formed in a so-called rod making machine wherein shreds or otherwise configurated particles of tobacco are showered into an elongated path to form a stream with an irregular (fluctuating) surplus of particulate material. The surplus is thereupon removed by a trimming or equalizing device, and the resulting filler is draped into a web of cigarette paper or the like with simultaneous compacting of the filler and bonding of overlapping marginal portions of the web to each other before the resulting rod passes through a suitable cutoff. The making of a continuous filter rod is analogous except that, if the particulate material consists of filaments which are made of a suitable synthetic plastic material and form a so-called tow which is sprayed with atomized plasticizer and thereupon passes through a gathering horn prior to draping into a web of cigarette paper, imitation cork or the like, the trimming operation can be omitted.

It is already known to monitor the density of the filler prior or subsequent to draping and to regulate one or more parameters which influence the density as a function of changes in the characteristics of signals which are generated by the density monitoring device.

German Auslegeschrift No. 11 59 326 discloses a cigarette rod making machine wherein the RPM of the distributor and the speed of the tobacco transporting conveyor (which receives particles of tobacco from the distributor) can be regulated in response to signals which denote the monitored density of the filler.

U.S. Pat. No. 3,731,693 discloses the possibility of regulating the pressure in a suction chamber adjacent to a tobacco transporting conveyor in response to signals which denote the density of the trimmed tobacco stream (filler).

U.S. Pat. No. 3,338,247 discloses a machine wherein the quantity of removed surplus tobacco is monitored downstream of the equalizing station and the thus obtained signals are used to regulate the operation of the distributor with a view to maintain the surplus at a constant value. None of the above proposals are entirely satisfactory because the density of the filler (and hence its resistance to the passage of smoke therethrough as well as the quantity of fibrous material therein) still tends to deviate from the optimum density.

OBJECTS AND SUMMARY OF THE INVENTION

An object of the invention is to provide a novel and improved method which can be utilized to form a continuous filler of fibrous material in such a way that the density of the filler invariably matches, or deviates only for very short periods of time from, an optimum density.

Another object of the invention is to provide a method which can be used for the making of highly satisfactory fillers of fibrous material including all types and forms of comminuted tobacco as well as certain filter materials for the making of filter plugs which are used in filter cigarettes, cigarillos or cigars.

A further object of the invention is to provide a method which ensures the making of superior rod-shaped smokers' products wherein the resistance to the flow of tobacco smoke always matches or very closely approximates an optimum resistance.

An additional object of the invention is to provide a method which ensures the making of tobacco-containing smokers' products whose weight does not deviate from the optimum weight even though it is not necessary to disregard certain other important features such as the resistance to the flow of tobacco smoke, the resistance to deformation and others.

Still another object of the invention is to provide a novel and improved apparatus for the practice of the above outlined method and to construct and assemble the apparatus in such a way that it can be incorporated in existing cigarette rod making machines as a superior substitute for heretofore known apparatus.

Another object of the invention is to provide an apparatus wherein the signals which are generated in response to monitoring of the density of a continuous filler of tobacco or other fibrous material can be processed and utilized in a novel and improved way to ensure that deviations of monitored density from an optimum density will be eliminated within surprisingly short intervals of time.

An additional object of the invention is to provide the apparatus with novel and improved means for controlling the operation of the distributor in a cigarette rod making or analogous machine for the purpose of preventing the making of a filler whose density deviates from an optimum density.

A further object of the invention is to provide novel and improved means for controlling the making and the transport of a tobacco stream in a cigarette rod making machine.

Another object of the invention is to provide an apparatus wherein the position of the means for removing the surplus of fibrous material need not be changed at all for the purpose of influencing the density of the filler.

One feature of the invention resides in the provision of a method of forming a filler of fibrous material, such as tobacco. The method comprises the steps of continuously feeding fibrous material at a variable rate and with a surplus above that which is required in the filler into a first portion of an elongated path to build up a stream of fibrous material (e.g., at the underside of the lower reach of an elongated air-permeable belt conveyor whose upper side travels along a stationary suction chamber) and moving the thus obtained stream in a predetermined direction along the path whereby the surplus extends beyond a fixed plane, removing the surplus in a second portion of the path downstream of the first portion (as considered in the predetermined direction) to thus convert the stream into a filler, monitoring the density of the filler (prior or subsequent to draping into a web of cigarette paper or the like), and varying the rate of feed of fibrous material into the first portion of the path including increasing the rate of feed when the monitored density of the filler decreases and reducing the rate of feed when the monitored density of the filler increases.

The method preferably further comprises the steps of establishing a pressure differential (such as with the aforementioned suction chamber above the upper side of the lower reach of the endless air-permeable belt conveyor) between two opposite sides of the stream in the first portion of the path, increasing the pressure differential when the monitored density of the filler decreases, and reducing the pressure differential when the monitored density of the filler increases. In addition to or in lieu of the just mentioned steps, the method can comprise the steps of establishing a pressure differential between two opposite sides of the stream in the region intermediate the first and second portions of the path, increasing the pressure differential when the monitored density of the filler decreases, and reducing the pressure differential when the monitored density of the filler increases.

The feeding step comprises establishing a source of fibrous material (e.g., a vertical duct with an open lower end) and transporting the material from such source to the first portion of the path at a variable rate (e.g., by resorting to one or more carded rotary drum-shaped conveyors). The method can further comprise the steps of increasing the speed of transport of fibrous material to the first portion of the path when the monitored density of the filler decreases and reducing the speed of transport of fibrous material to the first portion of the path when the monitored density of the filler increases.

The method preferably further comprises the step of generating first signals whose characteristics (e.g., intensity) denote the monitored density of the filler, and the varying step then comprises comparing the characteristics of such first signals with those of a reference signal (denoting the desired or optimum density of the filler) and reducing or increasing the rate of feed when the characteristics of a first signal (or a series of first signals) deviate from those of the reference signal to a predetermined extent, i.e., when the difference between such characteristics exceeds a preselected threshold value. The same procedure can be followed with variations of the aforediscussed pressure differential between two opposite sides of the stream in the first portion of the path and/or elsewhere in such path, i.e., the pressure differential can be increased (to enhance pneumatic densification of the stream) when the characteristics of a first signal or a series of first signals deviate to a predetermined extent from those of the reference signal and the monitored density of the filler is on the decrease, and reducing the pressure differential when the characteristics of a first signal or a series of first signals deviate from those of the reference signal to a predetermined extent while the monitored density of the filler is on the increase.

As a rule, the varying step takes up a predetermined interval of time in order to stabilize the modified rate of feed, and the method preferably further comprises the step of delaying the second of each two successive varying steps for an interval of time whose duration at least matches that of the predetermined interval. This prevents continuous fluctuations of the rate of feed of fibrous material to the first portion of the path.

The monitoring step can include directing X-rays or beta rays against successive increments of the filler and generating (the aforementioned first) signals denoting the intensity of radiation which penetrates through such increments of the filler.

The removing step can include clamping successive increments of the stream in the fixed plane in the second portion of the path and segregating from the remainder of each successive clamped increment of the stream all such fibrous material which extends beyond the fixed plane. Such removing step is or can be carried out while a pressure differential is established between two opposite sides of the stream in the second portion of the path so that the stream is densified or is maintained in densified condition in the course of the surplus removing step. As a rule, a pressure differential is also established between two opposite sides of the stream in the first portion of the path so that pneumatic densification begins as soon as the stream is formed, i.e., the growing stream is densified as a result of the establishment of such pressure differential in the first portion of the path. A pressure differential can be established between two opposite sides of the stream in the first portion of the path, in the second portion of the path and/or in a third portion between the first and second portions of the path. Such pressure differential can be varied by varying the speed of a rotary suction fan and/or by establishing an air flow from one side of the stream along a second path and throttling the flow of air in the second path to a variable extent.

Another feature of the invention resides in the provision of an apparatus for forming a filler of fibrous material, such as tobacco. The apparatus comprises a conveyor which defines at least a portion of an elongated path and serves to transport fibrous material along such path in a predetermined direction, a duct, a funnel, a magazine or another suitable source of fibrous material, adjustable means (e.g., one or more rotary drum-shaped carded conveyors) for feeding fibrous material at a variable rate from the source into a first portion of the path with a surplus above that which is required in the filler whereby the fibrous material forms in the first portion a growing stream and the conveyor transports the stream in the predetermined direction with the surplus of fibrous material extending beyond a predetermined fixed plane, equalizing means for removing the surplus from the stream in a second portion of the path downstream of the first portion to thus convert the stream into a filler, means for monitoring the density of successive increments or unit lengths of the filler and for generating signals whose characteristics are indicative of the monitored density of the respective increments or unit lengths of the filler, and means for adjusting the feeding means in response to such signals so as to increase the rate of feed when the monitored density of the filler is on the decrease and to reduce the rate of feed when the monitored density of the filler is on the increase. The conveyor is preferably permeable to air and has a first side facing the path and a second side facing away from the path. The apparatus preferably further comprises a suction chamber which is adjacent to the second side of the conveyor to attract fibrous material to the first side, and means for varying the pressure of air in the suction chamber in response to signals which are generated by the density monitoring means so as to reduce the pressure when the monitored density of the filler is on the increase and to raise the pressure when the monitored density of the filler is on the decrease. The suction chamber can be adjacent to the first portion, of the path, to the second portion of the path and/or to a third portion between the first and second portions.

The adjusting means preferably includes a source of reference signals, means for comparing the characteristics of the first signals (from the density monitoring means) with those of the reference signals, and means for increasing or reducing the rate of feed of fibrous material into the first portion of the path when the characteristics of the first signals deviate from those of the reference signals to a predetermined extent. The means for varying the pressure of air in the aforementioned suction chamber is preferably designed to effect a variation when the characteristics of the first signals deviate from those of the reference signals to a predetermined extent so as to increase the pressure in the suction chamber when the monitored density of the filler is on the increase and to reduce the pressure in the suction chamber when the monitored density of the filler is on the decrease.

As a rule, each adjustment of the feeding means and the completion of the resulting adjustment of the rate of feed to the first portion of the path takes up a predetermined interval of time and, therefore, the apparatus preferably further comprises means for preventing an adjustment of the feeding means following a preceding adjustment for an interval of time which at least matches the predetermined interval. This prevents continuous fluctuations of the rate of feed of fibrous material into the first portion of the path.

The monitoring means can include a source of X-rays or a source of beta rays at one side of the path of the filler and an ionization chamber which is disposed at another side of the path of the filler opposite the source of X-rays or beta rays and serves to generate the aforementioned first signals.

The equalizing means can comprise two mobile clamping members (e.g., two rotary disc-shaped clamping members) which cooperate to engage the fibrous material in the second portion of the path in the aforementioned fixed plane so that the surplus extends beyond the fixed plane in a direction away from the conveyor, and means (such as a driven paddle wheel or a driven rotary brush) for removing the surplus which extends beyond the fixed plane in the region where the fibrous material is clamped by the clamping members.

The means for varying the pressure of air in the suction chamber can comprise a suction generating device which is connected with the suction chamber and adjustable flow restrictor means which is interposed between the suction generating device and the suction chamber. Alternatively, the suction generating device can comprise a rotary fan and the pressure varying means then comprises means for varying the speed of the fan.

The apparatus can comprise one or more variable-speed conveyors, for propelling fibrous material into the first portion of the path at a variable speed, and the adjusting means can include means for varying the speed of the variable-speed conveyor or conveyors so that such speed increases when the monitored density of the filler is on the decrease and the speed decreases when the monitored density of the filler is on the increase.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
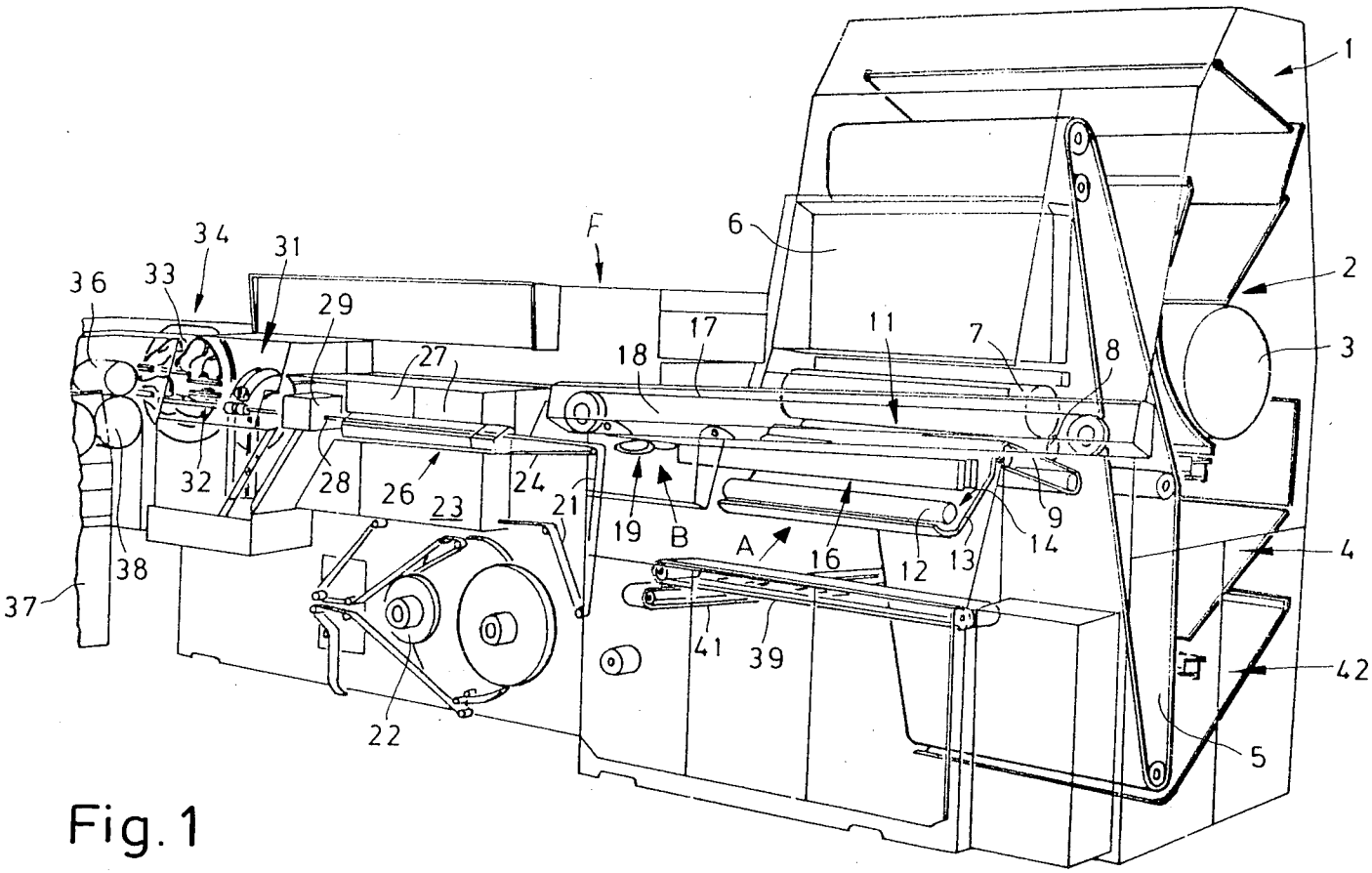
FIG. 1 is a schematic perspective view of a cigarette rod making machine with a filler forming apparatus which embodies the present invention.

Referring first to FIG. 1, there is shown a cigarette rod making machine of the type known as PROTOX (manufactured by the assignee of the present application). The machine comprises a frame F wherein a pivotable gate 1 is actuatable to admit batches of tobacco particles from the discharge end of a pneumatic conveyor into a first or primary distributor 2 which contains a substantial supply of tobacco particles and whose bottom wall is constituted by a rotary drum-shaped carded conveyor 3 serving to transfer metered quantities of tobacco particles into the magazine 4 of a second or main distributor. One side wall of the magazine 4 is constituted by the upwardly moving reach of an endless belt conveyor 5 having equidistant pockets (not specifically shown) serving to withdraw batches of tobacco particles from the supply in the magazine 4 and to dump such batches seriatim through the open upper end of a source of fibrous material here shown as an upright duct 6. The manner in which the conveyor 5 draws batches of tobacco particles from the magazine 4 and the manner in which such batches are dumped into the duct 6 are disclosed in commonly owned U.S. Pat. Nos. 4,185,644 to Heitmann et al. and 4,235,248 to Schumacher. A variable-speed drum-shaped carded conveyor 7 withdraws tobacco particles at a variable rate from the bottom of the column of tobacco in the duct 6 and cooperates with a rapidly rotating picker roller 8 which expels the particles from the carding and showers them onto the upper reach of an apron conveyor 9 driven at a constant speed. The tobacco stream which is expelled from the carding of the conveyor 7 is uniform and forms on the upper reach of the conveyor 9 a wide carpet whose leading end is propelled against a substantially vertical curtain 66 (FIG. 2) of compressed air issuing from a plenum chamber 67 whose inlet is connected to the pressure side of a blower 68. The plenum chamber 67 and the blower 68 constitute component parts of a tobacco sifting or classifying device 11. Heavier particles of tobacco penetrate through the curtain 66 and accumulate in an intercepting vessel **69*a* containing a rotating feed screw 69 which evacuates the accumulated heavier particles, either periodically or continuously. The heavier particles include fragments of tobacco ribs, birds' eyes and like parts. The lighter tobacco particles (primarily shreds of tobacco leaf laminae) are deflected by the air jets of the curtain 68 and enter a funnel 14 which is defined by an arcuate sheet metal wall 13 and a rotary drum-shaped carded conveyor 12. The carding of the conveyor 12 propels the lightweight tobacco particles against the underside of the lower reach of an endless air-permeable belt conveyor 17. The upper side of the lower reach of the conveyor 17 is adjacent to the air-permeable bottom wall of a stationary suction chamber 18 (see also FIG. 3) which is connected to a suction generating device 71 by a conduit 88. The streamlets of air which flow upwardly through the lower reach of the conveyor 17 attract the ascending particles of tobacco in a stream building zone A wherein the particles form a growing tobacco stream which adheres to the underside of the lower reach of the conveyor 17 due to the provision of the suction chamber 18 and advances with the conveyor 17 along an elongated slightly downwardly sloping path in a tobacco channel 16. The lower reach of the conveyor 17 constitutes the end wall or top wall of the channel 16 whose width determines the width of the tobacco stream 92**.

Figure 3:
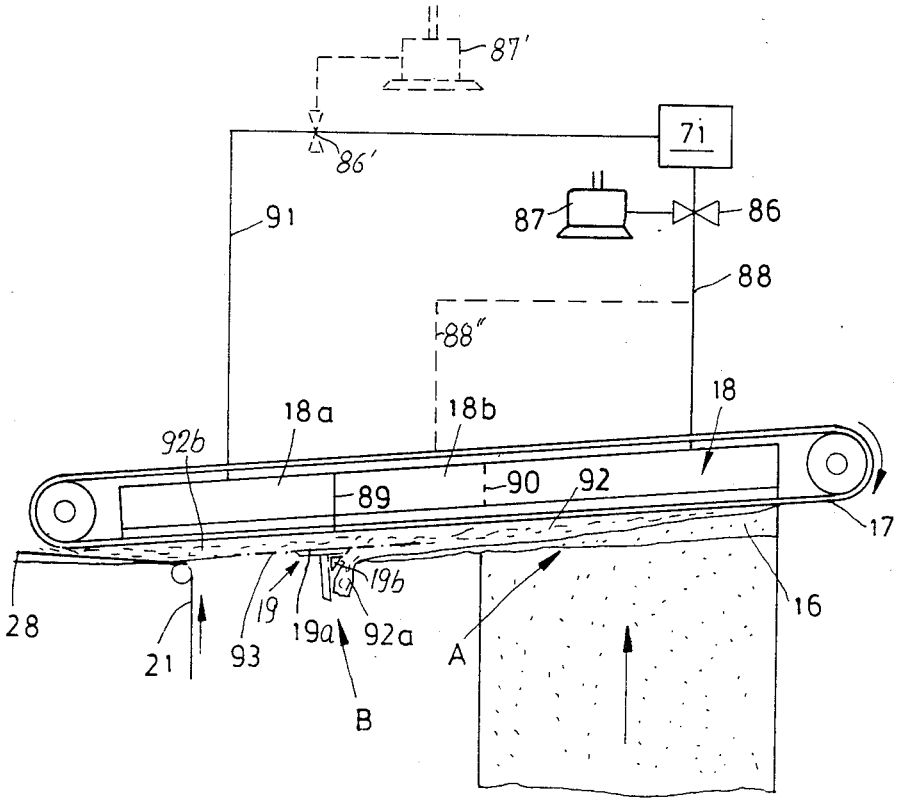
FIG. 3 is an enlarged elevational view of the stream transporting conveyor in the machine of FIG. 1.

A trimming or equalizing device 19 is adjacent to the path of the tobacco stream 92 downstream of the stream building zone A (in a second portion of the path for the tobacco stream 92, namely at a surplus removing station B) and includes two rotary tobacco clamping discs 19*a* cooperating with a rotating brush or paddle wheel to remove any and all tobacco particles which constitute the surplus and extend downwardly beyond a fixed equalizing plane 93 shown in FIG. 3. The distance between the equalizing plane 93 and the underside of the lower reach of the conveyor 17 is constant. In other words, the entire trimming device 19 need not move up or down (i.e., toward and away from the conveyor 17) when the machine is in actual use.

The provision of a trimming device is necessary because the tobacco stream 92 which is formed on the conveyor 17 at the station A contains a surplus of tobacco particles, namely, a surplus in such quantities that the distance between the deepmost portions of unavoidable valleys at the underside of the stream 92 and the conveyor exceeds the distance between the conveyor 17 and the plane 93.

The equalized tobacco stream (filler) 92*b* is thereupon deposited on the upper side of an endless belt conveyor 24, and more particularly on a continuous web 21 of cigarette paper which is drawn off a reel 22 and is caused to pass through a conventional imprinting mechanism 23 serving to apply to spaced-apart portions of the web 21 information such as the trademark of the manufacturer, the name of the manufacturer, the brand name of the article and/or others. The speed of the web 21 on the conveyor 24 matches the speed of the filler 92*b* and the web 21 is thereupon draped around the filler in a wrapping mechanism 26 in such a way that one marginal portion of the web extends tangentially of and away from the filler. The latter is compacted during passage through the wrapping mechanism 26 so that it forms a solid cylindrical rod. The outwardly extending marginal portion of the draped web 21 is coated with adhesive by a suitable paster (not shown) and is folded over the other marginal portion to form therewith a seam extending in parallelism with the axis of the resulting cigarette rod 28. The seam is heated or cooled by a tandem sealer 27, depending on the nature of adhesive paste. This ensures that the seam does not open during passage of the rod 28 through a cutoff 31 which subdivides the rod into plain cigarettes 32 of double unit length. The density of successive increments of the filler in the rod 28 is monitored by a density monitoring device 29 which mounted in the frame F ahead of the cutoff 31. The cigarettes 32 form a single file and are engaged and transported by successive orbiting arms 33 of a transfer device 34 which deposits such cigarettes on a rotary drum-shaped conveyor 36 of a filter tipping machine 37, e.g., a machine known as MAX or MAX S (both manufactured by the assignee of the present application). The machine 37 comprises a rotary disc-shaped cutter 38 which subdivides each cigarette 32 into two coaxial plain cigarettes of unit length, and such cigarettes are thereupon assembled with filter rod sections to form filter cigarettes of unit length or double unit length.

FIG. 1 further shows belt conveyors 39 and 41 which serve to transport the removed surplus of tobacco particles from the station B back to the secondary or main distributor, namely into a magazine 42 which is disposed at a level below the magazine 4 and is adjacent to the ascending reach of the conveyor 5 so that the pockets of this conveyor can remove from the magazine 42 small batches of returned discard tobacco or short tobacco before they advance into and remove shreds and fragments of ribs (if any) from the magazine 4.

The density monitoring device 29 can operate with X-rays (as disclosed in U.S. Pat. No. 3,056,026 to Bigelow) or with beta rays. In each instance, the rays are caused to penetrate into the filler of the running cigarette rod 28 and the intensity of those rays which have penetrated through the filler is ascertained by a suitable ionization chamber serving to generate electric signals (first signals) whose intensity or another characteristic is indicative of the density of successive increments of the filler in the rod 28. The apparatus will also comprises a suitable integrating or summing circuit 57 (FIG. 2) which furnishes signals denoting the average density of selected unit lengths of the trimmed and condensed filler 92*b*. Thus, the signals which are transmitted by the output of such summing or integrating circuit (which is conventional and, therefore, not specifically shown in the drawing) denote the density or mass of successive unit lengths of the rod 28 (e.g., the density of the fillers of successive coherent plain cigarettes of unit length).

Figure 2:
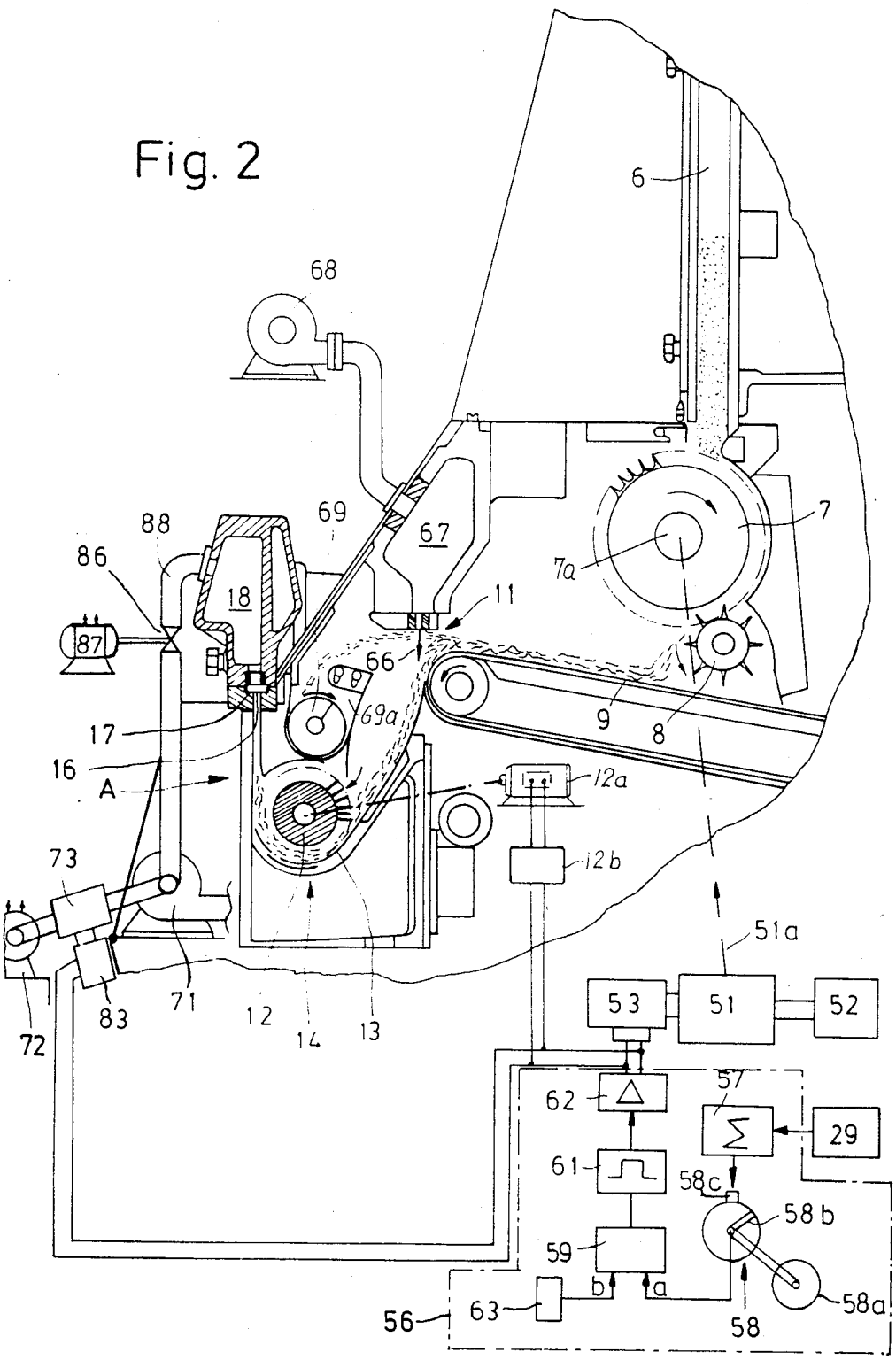
FIG. 2 is an enlarged schematic fragmentary vertical sectional view of the distributor in the machine of FIG. 1.

FIG. 2 illustrates a portion of the cigarette rod making machine which is shown in FIG. 1, namely the parts which transport and influence tobacco particles between the duct 6 (source of fibrous material) and the stream building zone A in the channel 16 at the underside of the lower reach of the air-permeable belt conveyor 17. The carded drum-shaped conveyor 7 constitutes a variable-speed tobacco feeding device whose shaft 7*a* is driven by a constant-speed or variable-speed prime mover 52 (e.g., the main prime mover of the cigarette rod making machine) through the medium of a variable-speed transmission 51. The operative connection 51*a* between the output element of the transmission 51 and the shaft 7*a* is indicated by a straight phantom line. For example, such operative connection can constitute the output element of the transmission 51. The ratio of the transmission 51 is adjustable by a servomotor 53 in indirect response to changes in the characteristics of (first) signals which are generated by the ionization chamber of the density monitoring device 29. The parts 51 to 53 constitute components of or cooperate with an adjusting circuit 56 which directly controls the servomotor 53 to initiate changes in the ratio of the transmission 51, with attendant changes in the rate of feed of fibrous material from the source 6 to the stream building zone A in a first portion of the path which is defined by the lower reach of the air-permeable conveyor 17, when the density of the filler 92*b* in the cigarette rod 28 deviates from an optimum value. The adjusting circuit 56 comprises the aforementioned summing or integrating circuit 57 for the signals which are transmitted by the output of the ionization chamber in the density monitoring device 29, a timer or time-delay unit 58, a signal comparing stage 59, a monostable multivibrator 61 for transmission of control signals of predetermined duration and amplitude, and an amplifier 62 whose output is connected with the input or inputs of the servomotor 53.

The timer 58 serves to prevent the transmission of successive signals to the servomotor 53 within intervals which are shorter than a preselected interval, namely an interval which is required to stabilize the adjusted rate of feed of fibrous material from the duct 6 into the stream building zone A. The input of the timer 58 is connected with the output of the integrating circuit 57, and this timer is adjustable so as to ensure that its output transmits to the corresponding input a of the signal comparing stage 59 a signal with a preselected delay following the transmission of a signal from the output of the integrating circuit 57. The reasons for the provision of the timer 58 will be readily appreciated by taking into consideration the fact that a certain interval of time must elapse between the instant of actual adjustment of the RPM of the conveyor 7 by the transmission 51 via operative connection 51*a* and full or substantial stabilization of the thus altered rate of tobacco feed into the stream building zone A in the first portion of the path which is defined by the conveyor 17. Changes in the RPM of the conveyor 7 at intervals which are shorter than the just discussed stabilization interval could create a continuous imbalance in the rate of feed and attendant continuous fluctuations of density of the filler 92*b*.

In the embodiment of FIG. 2, the timer 58 comprises a driven rotary contact arm 58*b* which is rotated by a motor 58*a* at a variable speed and engages a stationary contact element 58*c* at intervals whose duration is determined by the speed of the motor 58*a*. When the arm 58*b* engages the contact element 58*c* of the timer 58, the latter transmits an integrated first signal from the output of the circuit 57 to the input a of the signal comparing stage 59. It is clear that the illustrated timer 58 constitutes but one form of means for delaying the transmission of signals from the integrating circuit 57 to the signal comparing stage 59 for preselected intervals. In many instances, such relatively simple timer will be replaced with a more sophisticated or more compact (e.g., electrical or electronic) time delay unit.

The input b of the signal comparing stage 59 is connected to a source 63 (e.g., an adjustable potentiometer) of reference signals. The signal at the input b of the stage 59 denotes the desired or optimum density of the filler 92*b* in the cigarette rod 28.

The operation of the machine which embodies the structure shown in FIGS. 1 and 2 is as follows:

If the density monitoring device 29 ascertains that successive increments of the condensed filler 92*b* in the cigarette rod 28 are too soft, i.e., that their density is insufficient, the intensity and/or another characteristic of the signals which are transmitted to the summing or integrating circuit 57 is also indicative of a density that is too low. The output of the integrating circuit 57 transmits integrated signals to the input a of the stage 59 at intervals which are selected by the timer 58 (i.e., by the speed of the motor 58*a*). The stage 59 compares such signals with the reference signal from the source 63 and transmits a signal (with a positive or a negative sign) when the difference between the characteristics of the signal from the circuit 57 and the reference signal reaches a preselected threshold value. The monostable multivibrator 61 converts the signal at the output of the stage 59 into a signal of predetermined amplitude and duration, and such signal is amplified at 62 prior to transmission to the servomotor 53. Each signal from the amplifier 62 induces a rotary component of the servomotor 53 to complete an incremental angular movement in a clockwise or counterclockwise direction with attendant change in the ratio of the transmission 51 and in the RPM of the conveyor 7. If the signal at the output of the amplifier 62 is indicative of a density which is below the optimum value, the angular displacement of the rotary component of the servomotor 53 takes place in a direction to reduce the transmission ratio, i.e., to increase the RPM of the conveyor 7 and to thus increase the rate of feed of fibrous material from the duct 6 to the stream building zone A. In other words, the rate of tobacco withdrawal from the duct 6 per unit of time is increased with the result that the stream building zone A receives more tobacco per unit of time. Tobacco particles which are withdrawn by the carding of the conveyor 7 are expelled from the carding by the picker roller 8 which propels such particles onto the upper reach of the apron conveyor 9 which accumulates a wide layer of tobacco particles and propels the leader of such layer against the curtain 66 of compressed air issuing from the plenum chamber 67 of the classifying device 11. The trajectories of heavier tobacco particles (such as fragments of ribs) remain unaffected, i.e., such particles penetrate through the curtain 66 and accumulate in the intercepting vessel 69*a* to be evacuated (when necessary) by the feed screw 69. The lighter tobacco particles (primarily shreds) are deflected by the curtain 66 and enter the funnel 14 wherein they slide along the concave inner side of the arcuate wall 13 and into the range of the carding on the rotating conveyor 12 which propels such particles into the channel 16, namely into the first portion (stream building zone A) of the elongated path which is defined by the lower reach of the air-permeable conveyor 17. The RPM of the conveyor 12 is sufficiently high to ensure that all particles of tobacco enter the stream building zone A wherein they form a growing stream which is attracted to the lower reach of the conveyor 17 as a result of the establishment of a pressure differential by the suction chamber 18. The suction generating device 71 (e.g., a suitable fan) draws air from the suction chamber 18 via conduit 88. The rotor of the suction generating device 71 is driven by a motor 72 by way of a transmission 73 whose ratio is adjustable by a servomotor 83 to thereby vary the pressure in the suction chamber 18.

When the zone A begins to receive larger quantities of tobacco per unit of time, the quantity of the surplus 92*a* (see FIG. 2) as well as the density of the equalized stream (filler) 92*b* increases. Such more pronounced densification is attributable to the provision of the suction chamber 18 which effects a more pronounced pneumatic compression or densification of the growing stream as well as of the fully grown stream 92 than if such stream were to contain less tobacco per unit length. More pronounced densification of the fully grown stream 92 results in a proportionally reduced quantity of surplus tobacco (i.e., of tobacco which extends downwardly beyond the fixed plane 93) so that the filler 92*b* contains more tobacco than before and this is detected by the monitoring device 29.

The input a of the signal comparing stage 59 receives from the integrating circuit 57 a fresh signal with a delay which is determined by the setting of the timer 58. Such signal is compared with the reference signal from 63 and, if the difference between the two signals exceeds a preselected threshold value (i.e., if the density of the monitored filler 92*b* is still too low), the output of the stage 59 again transmits a signal which is shaped at 61, amplified at 62 and transmitted to 53 for effecting a change in the ratio of the transmission 51 with a view to further increase the rate of tobacco feed from the duct 6 to the stream building zone A. This entails a further increase of surplus in the tobacco stream 92, a more pronounced densificatin during travel of the stream 92 along the suction chamber 18, and an increase in the density of the filler 92*b*.

If the mass of successive increments of the filler 92*b* in the cigarette rod 28 is excessive, the signals which are transmitted by the ionization chamber of the density monitoring device 29 and are integrated by the circuit 57 are indicative of excessive density. The stage 59 compares the signal which is transmitted thereto via timer 58 with the reference signal from the source 63 and, if the difference between the two signals is sufficiently pronounced, the output of the stage 59 transmits a signal of opposite polarity (as compared with a signal which is indicative of insufficient density of the filler 92*b*); such signal is shaped at 61, amplified at 62 and used to effect an incremental angular movement of the servomotor 53 in the opposite direction, namely, in a direction to reduce the ratio of the transmission 51 and to thus reduce the rate of feed of particulate material from the source 6 to the stream building zone A. The stream 92 which is formed on the conveyor 17 contains a smaller surplus and is subjected to less pronounced densifying action so that the density of the filler 92*b* is reduced. The same procedure can be repeated if a one-stage reduction of the RPM of the conveyor 7 does not suffice to return the density of the filler 92*b* to the desired optimum value corresponding to that which is denoted by the characteristics of the reference signal at the input b of the signal comparing stage 59.

It will be noted that the improved machine is capable of rapidly and effectively varying the density of the filler 92*b* in a sense to restore the optimum density with a minimum of delay in spite of the fact that the machine employs a rather simple equalizing device 19, namely an equalizing device which need not continuously move up and down as in many heretofore known cigarette rod making and analogous machines. In other words, the density of the filler 92*b* can be varied practically instantaneously when the monitoring device 29 detects that the density of the filler is excessive or too low in spite of the fact that the trimming or surplus removing plane 93 is a fixed plane whose distance from the lower reach of the conveyor 17 remains unchanged.

The density of the filler 92*b* can be restored to the optimum value with an even higher degree of accuracy, and after the elapse of an even shorter interval of time, if the signals which are transmitted by the amplifier 62 of the adjusting circuit 56 are further applied to the inputs of the servomotor 83 which varies the ratio of the transmission 73 for the rotor of the suction generating device 71. The construction of the servomotor 83 can be analogous to that of the servomotor 53, i.e., the servomotor 83 can comprise a rotary ratio-changing component which can be indexed incrementally in response to the signals which are transmitted by the amplifier 62. The incremental angular displacement will take place in a clockwise or in a counterclockwise direction, depending on the polarity of the signal at the output of the amplifier 62. The polarity of such signal, in turn, depends upon the positive or negative deviation of monitored density of the filler 92*b* from an optimum value.

If the monitored density of the filler 92*b* drops below the optimum density to an extent which is required to induce the stage 59 to transmit a signal of corresponding polarity to the monostable multivibrator 61, the servomotor 83 is caused to change the ratio of the transmission 73 with a view to increase the RPM of the rotor of the suction generating device 71 and to thus reduce the pressure in the suction chamber 18. The resulting intensification of suction in the chamber 18 entails a more pronounced penumatic densification of the stream 92 and the removal of a smaller quantity of surplus tobacco 92*a* at the surplus removing station B. If the density of the filler 92*b* is still too low, the amplifier 62 transmits to the servomotor 83 a further signal (with a delay which is determined by the timer 58) whereby the RPM of the rotor in the suction generating device 71 is increased still further and the tobacco stream 92 is subjected to a more pronounced penumatic densifying action, i.e., the trimming device 19 removes a smaller quantity of surplus tobacco 92*a* and the density of the filler 92*b* is increased.

If the density of the filler 92*b* is too high, the signals which are generated by the monitoring-device 29 are converted into a signal which causes the servomotor 83 to reduce the RPM of the rotor in the signal generating device 71 via transmission 73 so that the pressure in the suction chamber 18 rises, the tobacco stream 92 is subjected to a less pronounced densifying action, and the trimming device 19 removes a larger quantity of surplus tobacco. The same procedure can be repeated again and again (at a frequency not exceeding that which is determined by the setting of the timer 58) until the density of the filler 92*b* is reduced to the value which is selected by the setting of the source 63 of reference signals.

If desired, the pressure in the chamber 18 can be varied by an adjustable flow restrictor 86 which is installed in the conduit 88 between the suction generating device 71 and the outlet of the chamber 18 and whose setting can be adjusted by a suitable motor 87. In such apparatus, the RPM of the rotor of the suction generating device 71 can remain constant and the servomotor 83 is then used to adjust the flow restrictor 86 via motor 87 to thus determine the setting of the flow restrictor 86 and influences the pressure in the suction chamber 18. If the effective cross-sectional area of the flow restrictor 86 is increased, the pressure in the suction chamber 18 drops, and vice versa.

It has been found that the density of the filler 92*b* can be restored to the optimum value with a minimum of delay if the adjusting circuit 56 regulates the RPM of the conveyor 7 (i.e., the rate of feed of fibrous material to the stream building zone A) as well as the pressure in the suction chamber 18 (i.e., the pneumatic densifying action upon the tobacco stream 92).

FIG. 3 shows that the internal space of the suction chamber 18 can be subdivided into two or more compartments by one or more partitions. If the suction chamber 18 contains a single partition 89, the internal space of this suction chamber is subdivided into a first compartment 18*a* above the surplus removing station B (second portion of the path which is defined by the lower reach of the conveyor 17) and a second compartment 18*b* above the stream building zone A as well as above that (third) portion of the path which extends between the zone A and station B. A second partition 90 can be provided to subdivide the compartment 18*b* into two shorter compartments one of which is located above the stream building zone A and the other of which is located above the aforementioned third portion of the path for the stream 92.

The compartment 18*a* is connected to the suction side of the fan 71 which constitutes the suction generating device by a conduit 91 which does not contain any adjustable flow restrictor means or any other pressure regulating means. In other words, the subatmospheric pressure in the compartment 18*a* adjacent to the surplus removing station B can be maintained at a constant value. Otherwise stated, the pressure differential between the upper side of the stream 92 at the station B and the underside of such stream is constant. The conduit 88 contains the aforementioned adjustable flow restrictor 86 whose effective cross-sectional area (and hence the pressure in the compartment 18*b* of the suction chamber 18) can be regulated by the motor 87 in response to signals from the amplifier 62 in the adjusting circuit 56 of FIG. 2. In other words, the pressure in the compartment 18*b* can be raised or lowered in dependency on the characteristics of signals which are generated by the monitoring device 29 and denote the density of the filler 92*b*. The plane 93 of removal of surplus tobacco 92*a* is fixed, the same as described with reference to FIG. 2.

The construction of the surplus removing or trimming device 19 may be identical with or analogous to that of the equalizing device which is disclosed in U.S. Pat. No. 3,769,989. In the equalizing device of this patent, the means for removing the surplus below the plane which is defined by two rotary disc-shaped clamping elements, whose peripheral speed matches the speed of the tobacco stream, is a rapidly rotating brush. Such brush can be replaced with a paddle wheel 19*b* (shown schematically in FIG. 3).

The structure which is shown in FIG. 3 can be modified in a number of ways without departing from the spirit of the invention. For example, the conduit 91 can also contain a flow restrictor 86' (indicated by broken lines) and a motor 87' for adjusting the flow restrictor 86' in response to signals from the density monitoring device 29. Alternatively or in addition to the provision of the parts 86', 87', the structure of FIG. 3 can comprise a conduit 88'' which is connected to the conduit 88 upstream of the adjustable flow restrictor 86 so that the pressure in the left-hand portion of the compartment 18*b* (to the left of the partition 90) can be varied simultaneously with the pressure in the right-hand portion of the compartment 18*b* or independently thereof (if the parts 86 and 87 are installed directly in the conduit 88'' and the conduit 88 is connected directly to the suction intake of the suction generating device 71 without any adjustable fluid flow regulating means therebetween. All in all, suction in the entire chamber 18 is normally needed in order to attract the stream 92 to the underside of the lower reach of the conveyor 17. However, the suction can be regulated (i.e., the pressure differential between the upper side and the underside of the stream 92 can be varied) only in the zone A, only at the station B, only in the third portion of the path (between the zone A and station B), in the zone A and at the station B, at the station B and in the third portion of the path, in the third portion and in the zone A, or all the way along the full length of the suction chamber 18. It is often desirable to construct the apparatus in such a way that the pressure above the stream building zone A remains constant (in order not to adversely influence the forming of the stream 92) and that the pressure varies between the partitions 89 and 90, between the partition 90 and the left-hand end of the suction chamber 18, or only between the partition 89 and the left-hand end of the suction chamber (as viewed in FIG. 3).

It is to be understood that the position (level) of the trimming or equalizing device 19 can be changed, for example, to select the initial position of the plane 93. However, the level of the device 19 need not be changed in response to signals which are generated by the density monitoring device 19. The level of the device 19 in the frame F of the cigarette rod making machine can be changed manually or by a motor (not shown) which can be started by remote control from the control panel of the machine.

The quality of the filler 92*b* can be improved still further if the machine is equipped with means for regulating the quantity of surplus tobacco (i.e., with the variable-speed conveyor 7 which determines the rate of removal of tobacco from the source 6) as well as with means for varying the speed at which the particles of tobacco are propelled into the stream building zone A. This is shown in FIG. 2 wherein the signals which appear at the output of the amplifier 62 in the adjusting circuit 56 are further transmitted to an operational amplifier 12*b* in the circuit of a motor 12*a* which drives the carded drum-shaped conveyor 12 in the funnel 14 at a variable speed. This feature can be employed in combination with adjustment of the RPM of the conveyor 7 and in combination with adjustment of pressure in the suction chamber 18. The operational amplifier 12*b* is of known design; it operates in such a way that the RPM of the motor 12*a* for the conveyor 12 is increased when the signal at the output of the amplifier 62 is indicative of a filler density which is too low. Inversely, the RPM of the motor 12*a* is reduced when the nature of the signal at the output of the amplifier 62 is such that the signal denotes a density which is too high. All the operational amplifier 12*b* has to do is to change the control potential for the motor 12*a*. The provision of a variable-speed motor 12*a* for the conveyor 12 further enhances the effectiveness of regulation of the quantity of surplus (especially if the variable-speed motor 12*a* is used in conjunction with means for varying the pressure in a portion of or in the entire suction chamber 18). This is due to the fact that densification of tobacco in the stream building zone A depends to a certain extent upon the speed of particulate material which is being propelled by the conveyor 12 or by an analogous (mechanical and/or pneumatic) conveyor.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of forming a filler of fibrous material, such as tobacco, comprising the steps of continuously feeding fibrous material at a variable rate and with a surplus above that which is required in the filler into a first portion of an elongated path to build up a stream and moving the thus obtained stream in a predetermined direction along said path whereby the surplus extends beyond a fixed plane; removing the surplus which extends beyond said plane in a second portion of said path downstream of said first portion, as considered in said direction, to thus convert the stream into a filler; monitoring the density of the filler; and varying the rate of feed of fibrous material into the first portion of said path, including increasing the rate of feed when the monitored density of the filler decreases and reducing the rate of feed when the monitored density of the filler increases.

2. The method of claim 1, further comprising the steps of establishing a pressure differential between two opposite sides of the stream in the first portion of said path, increasing said pressure differential when the monitored density of the filler decreases, and reducing said pressure differential when the monitored density of the filler increases.

3. The method of claim 1, further comprising the steps of establishing a pressure differential between two opposite sides of the stream intermediate the first and second portions of said path, increasing said pressure differential when the monitored density of the filler decreases, and reducing said pressure differential when the monitored density of the filler increases.

4. The method of claim 3, further comprising the steps of establishing a second pressure differential between two opposite sides of the stream in the first portion of said path, increasing the second pressure differential when the monitored density of the filler decreases, and reducing said second pressure differential when the monitored density of the filler increases.

5. The method of claim 1, wherein said feeding step includes establishing a source of fibrous material and transporting the material from the source to the first portion of said path at a variable speed, and further comprising the steps of increasing the speed of transport of fibrous material when the monitored density of the filler decreases and reducing the speed of transport of fibrous material when the monitored density of the filler increases.

6. The method of claim 1, further comprising the step of generating first signals whose characteristics denote the monitored density of the filler, said varying step including comparing the characteristics of first signals with those of a reference signal and reducing or increasing the rate of feed when the characteristics of a first signal deviate from those of the reference signal to a predetermined extent.

7. The method of claim 6, further comprising the steps of establishing a pressure differential between two opposite sides of the stream ahead of the second portion of said path, increasing said pressure differential when the characteristics of a first signal deviate to a predetermined extent from those of said reference signal and the monitored density of the filler is on the decrease, and reducing said pressure differential when the characteristics of a first signal deviate from those of said reference signal to a predetermined extent while the monitored density of the filler is on the increase.

8. The method of claim 6, wherein said varying step takes up a predetermined interval of time and further comprising the step of delaying the second of each two successive varying steps for an interval of time whose duration at least matches that of said predetermined interval.

9. The method of claim 1, wherein said monitoring step includes directing X-rays against successive increments of the filler and generating signals denoting the intensity of radiation which penetrates through such increments of the filler.

10. The method of claim 1, wherein said monitoring step includes directing beta rays against successive increments of the filler and generating signals denoting the intensity of radiation which penetrates through such increments of the filler.

11. The method of claim 1, wherein said removing step includes clamping successive increments of the stream in said plane in the second portion of said path and segregating from the remainder of each successive clamped increment of the stream all such fibrous material which extends beyond said plane.

12. The method of claim 11, further comprising the step of establishing a pressure differential between two opposite sides of the stream in the second portion of said path so that the stream is densified by such pressure differential in the course of the surplus removing step.

13. The method of claim 12, further comprising the step of establishing a pressure differential between said opposite sides of the stream in said first portion of said path so that the growing stream is densified as a result of the establishment of such pressure differential.

14. The method of claim 1, further comprising the step of establishing a pressure differential between two opposite sides of the stream in at least one of the first and second portions of said path to thereby densify the stream, including reducing the pressure at one of said sides to below atmospheric pressure.

15. The method of claim 14, further comprising the step of varying said pressure differential at said one side of the stream, including varying the speed of a rotary suction fan.

16. The method of claim 14, further comprising the step of varying said pressure differential at said one side of the stream, including establishing an air flow from said one side of the stream along a second path and throttling the flow of air in said second path to a variable extent.

17. Apparatus for forming a filler of fibrous material, such as tabacco, comprising a conveyor defining an elongated path and arranged to transport fibrous material along said path in a predetermined direction; a source of fibrous material; adjustable means for feeding fibrous material at a variable rate from said source into a first portion of said path with a surplus above that which is required in the filler whereby the fibrous material forms in said first portion a growing stream and the conveyor transports the stream in said direction with the surplus extending beyond a predetermined fixed plane; equalizing means for removing from the stream the surplus which extends beyond said fixed plane in a second portion of said path downstream of said first portion to thus convert the stream into a filler; means for monitoring the density of successive increments of the filler and for generating signals whose characteristics are indicative of the monitored density of the respective increments; and means for adjusting said feeding means in response to said signals so as to increase the rate of feed when the monitored density of the filler is on the decrease and to reduce the rate of feed when the monitored density of the filler is on the increase.

18. The apparatus of claim 17, wherein said conveyor is permeable to air and has a first side facing said path and a second side facing away from the path, and further comprising a suction chamber adjacent to said second side to attract fibrous material to said first side, and means for varying the pressure of air in said suction chamber in response to said signals so as to reduce such pressure when the monitored density of the filler is on the increase and to raise such pressure when the monitored density of the filler is on the decrease.

19. The apparatus of claim 18, wherein said suction chamber is adjacent to said first portion of said path.

20. The apparatus of claim 18, wherein said suction chamber is adjacent to a third portion of said path between said first and second portions.

21. The apparatus of claim 17, wherein said adjusting means includes a source of reference signals, means for comparing the characteristics of said first signals with those of said reference signals, and means for increasing or reducing the rate of feed of fibrous material into the first portion of said path when the characteristics of said first signals deviate from those of said reference signals to a predetermined extent.

22. The apparatus of claim 21, wherein said conveyor is permeable to air and has a first side facing said path and a second side facing away from said path, and further comprising a suction chamber adjacent to said second side to attract fibrous material to said first side, and means for varying the pressure in said suction chamber when the characteristics of said first signals deviate from those of said reference signals to a predetermined extent so as to increase the pressure in said chamber when the monitored density of the filler is on the increase and to reduce the pressure in said chamber when the monitored density of the filler is on the decrease.

23. The apparatus of claim 17, wherein each adjustment of said feeding means takes up a predetermined interval of time and further comprising means for preventing an adjustment of said feeding means following a preceding adjustment for an interval of time which at least matches said predetermined interval.

24. The apparatus of claim 17, wherein said monitoring means includes a source of X-rays at one side of the filler and an ionization chamber at another side of the filler opposite said source of X-rays.

25. The apparatus of claim 17, wherein said monitoring means includes a source of beta rays at one side of the filler and an ionization chamber at another side of the filler opposite said source of beta rays.

26. The apparatus of claim 17, wherein said equalizing means comprises two mobile clamping members cooperating to engage the fibrous material in the second portion of said path in said plane so that the surplus extends beyond such plane in a direction away from said conveyor, and means for segregating the surplus which extends beyond said plane.

27. The apparatus of claim 26, wherein said segregating means comprises a paddle wheel.

28. The apparatus of claim 26, wherein said segregating means comprises a rotary brush.

29. The apparatus of claim 17, wherein said conveyor is permeable to air and has a first side facing said path and a second side facing away from said path, and further comprising a suction chamber adjacent to said second side to attract fibrous material to said first side, and means for varying the pressure in said suction chamber including a suction generating device connected with said suction chamber and adjustable flow restrictor means interposed between said device and said suction chamber.

30. The apparatus of claim 17, wherein said conveyor is permeable to air and has a first side facing said path and a second side facing away from said path, and further comprising a suction chamber adjacent to said second side to attract fibrous material to said first side, and means for varying the pressure in said suction chamber including a rotary fan and means for varying the speed of rotation of said fan.

31. The apparatus of claim 17, wherein said feeding means comprises a variable-speed conveyor arranged to propel fibrous material into the first portion of said path and said adjusting means includes means for varying the speed of said variable-speed conveyor so that such speed increases when the monitored density of the filler is on the decrease and that such speed decreases when the monitored density of the filler is on the increase.

* * * * *